US012129598B2

(12) United States Patent
Muhli et al.

(10) Patent No.: US 12,129,598 B2
(45) Date of Patent: Oct. 29, 2024

(54) ARRANGEMENT FOR INSTALLATION OF MONITORING SENSORS OF A TREATMENT VESSEL FOR LIGNOCELLULOSIC MATERIAL

(71) Applicant: ANDRITZ OY, Helsinki (FI)

(72) Inventors: Aki Muhli, Kotka (FI); Tomi Suikki, Kotka (FI)

(73) Assignee: ANDRITZ OY, Helsinki (FI)

( * ) Notice: Subject to any disclaimer, the term of this patent is extended or adjusted under 35 U.S.C. 154(b) by 577 days.

(21) Appl. No.: 17/295,596

(22) PCT Filed: Nov. 21, 2019

(86) PCT No.: PCT/FI2019/050834
§ 371 (c)(1),
(2) Date: May 20, 2021

(87) PCT Pub. No.: WO2020/104730
PCT Pub. Date: May 28, 2020

(65) Prior Publication Data

US 2022/0018067 A1 Jan. 20, 2022

(30) Foreign Application Priority Data

Nov. 22, 2018 (FI) ..... 20185988

(51) Int. Cl.
*D21C 7/12* (2006.01)

(52) U.S. Cl.
CPC ..... *D21C 7/12* (2013.01)

(58) Field of Classification Search
CPC ..... D21C 7/12
See application file for complete search history.

(56) References Cited

U.S. PATENT DOCUMENTS 4,462,319 A * 7/1984 Larsen ..... A62C 31/22 162/1
4,933,292 A 6/1990 Savisalo et al.
(Continued)

FOREIGN PATENT DOCUMENTS

WO 2012/026856 3/2012
WO 2016/112203 7/2016
(Continued)

OTHER PUBLICATIONS

Written Opinion cited in PCT/FI2019/050834, Feb. 19, 2020, 9 pages.

(Continued)

*Primary Examiner* — Jacob T Minskey
*Assistant Examiner* — Stephen M Russell
(74) *Attorney, Agent, or Firm* — Nixon & Vanderhye P.C.

(57) ABSTRACT

An arrangement for installations of monitoring sensors of a vessel for treatment of lignocellulosic material, which vessel (1) has a central pipe (2) including at least one concentric pipe (3), mounted coaxially within the vessel (1). At least one sensor channel (4) is arranged along the outermost wall of the concentric pipe (3) of the central pipe (2) and that the at least one sensor channel (4) is connected to a cable conduit (5), which cable conduit (5) connects the exterior of the vessel (1) to the at least one sensor channel (4)) and the sensor channel (4) is several meters long and has plurality of holders (13) for sensors (11) and/or is configured to contain plurality of thermal sensors (11) with their cables (8).

18 Claims, 4 Drawing Sheets

(56) References Cited

U.S. PATENT DOCUMENTS

| | | | | |
|---|---|---|---|---|
| 5,167,769 | A | 12/1992 | Jack et al. | |
| 5,547,545 | A | 8/1996 | Egi et al. | |
| 5,882,477 | A | 3/1999 | Laakso et al. | |
| 2006/0108465 | A1* | 5/2006 | Barscevicius | B02C 25/00 241/261.2 |
| 2009/0188641 | A1* | 7/2009 | Tuuri | D21C 7/12 162/263 |
| 2013/0074358 | A1* | 3/2013 | Qu | D21F 5/024 219/521 |
| 2013/0248127 | A1 | 9/2013 | Pulliainen | |

FOREIGN PATENT DOCUMENTS

| | | | |
|---|---|---|---|
| WO | WO-2016112203 | A1 * | 7/2016 |
| WO | 2017/204736 | | 11/2017 |

OTHER PUBLICATIONS

International Search Report cited in PCT/FI2019/050834 mailed Feb. 19, 2020, 6 pages.

* cited by examiner

ARRANGEMENT FOR INSTALLATION OF MONITORING SENSORS OF A TREATMENT VESSEL FOR LIGNOCELLULOSIC MATERIAL

RELATED APPLICATIONS

This application is the U.S. national phase of International Application PCT/FI2019/050834 filed Nov. 21, 2019, which designated the U.S. and claims priority to Finnish Patent Application 20185988 filed Nov. 22, 2018, the entire contents of each of these applications are incorporated by reference.

TECHNICAL FIELD

This invention relates to an arrangement for installation of monitoring sensors of a vessel for treatment of lignocellulosic material, which vessel has a central pipe.

BACKGROUND OF THE INVENTION

The pulp and paper industry, and other process industries, employ chemical reactions in processes that are often performed in vessels under pressures greater than atmospheric pressure. Typically, these processes are performed within vessels that maintain the product at predetermined superatmospheric pressures and at elevated temperatures to promote the desired chemical reaction. These pressurized vessels may be 100 meters tall and have a bottom diameter of about 6 meters to more than 12 meters. These pressurized vessels typically operate at a pressure of 3 to 6 bar or even 8 to 10 bar at the top of the pressurized vessel.

Processing lignocellulosic material in this manner is known as "cooking". Such vessels include continuous or batch impregnation and digester vessels. Lignocellulosic material may refer to wood chips, plant material, bagasse, wheat straw, mixed corn stover, mixed municipal waste and other cellulosic material.

In a continuous cooking system, there is a continuous flow of chips into the pressure vessels (for example, impregnation vessels and digester vessels) and a continuous flow of processed chips out of the pressure vessels. Typically, when using a pressure vessel to produce pulp from chips, the chips are fed to a pressure vessel along with cooking liquor or a mix of cooking liquor and water. For simplicity, the vessel with its installations is referred as "digester" in this disclosure.

The pressurized vessel, or vessels, in the cooking system may be either a hydraulic phase vessel or a vapor phase vessel. In a hydraulic phase vessel, the vessel contains liquid up to and above the level of the chips. In a vapor phase vessel, the liquid level is below the top of the vessel, usually below the chip level, which thereby leaves a vapor space above the liquid level. This vapor space typically receives steam. The steam or other gaseous compounds can heat the chips.

The pressurized vessel of a continuous cooking system may have multiple process zones. The process zones may include an impregnation zone, a heating zone, a cooking zone, a washing zone, and a cooling zone. Operators inject fluids to pretreat and cook the chips in the impregnation, heating, and cooking zones. Additionally, operators normally inject washing and cooling fluids in the wash and cooling zones. Wash liquid can decrease the concentration of dissolved organics in a wash zone and can facilitate chip cooling before the chips are discharged from the pressurized vessel.

Typically, liquids are introduced to the chip column by means of a central pipe arrangement suspended from the top of the vessel. The central pipe comprises coaxial pipes, which extend to different elevations, typically to the vicinity of screen assemblies. The central pipe is typically used to introduce heated liquids containing cooking chemical, for example, kraft white liquor, to the chips within the digester.

The measuring and monitoring of the chip level typically involves the use of paddles. Pressure differences at different elevations can be used for measuring liquid level in the pressurized vessel. Such a system is described in U.S. Pat. No. 5,882,477.

Chip levels are measured by inserting paddles with strain gauges into the pressurized vessels. Because the strain gauge extends into the vessel by a relevant distance, the arrangement is vulnerable to breaking as chips move past and bend the paddles. US2013248127 discloses an arrangement for electrochemically measuring the levels from the top of the digester. Such an arrangement may bend and be damaged by uneven flow of chips and cannot extend below the top of the central pipe if it exists within the digester. U.S. Pat. No. 5,167,769 also discloses another solution for measuring the level of chips within a digester.

One of the most important cooking parameters is residual alkali concentration in black liquor. To measure residual alkali concentrations, operators generally take samples from a point source. A point source may be a sample port in the vessel wall. In some vessels, an operator may physically insert a sampling rod through the sample port to collect the sample. In other digesters, the point source may be an automatic sampling apparatus that isolates a sample from discharged liquid. Operators use such point source information to control the application rate of cooking liquor in certain zones.

The measuring of alkali level in current systems requires samples to be taken and processed outside the vessel. Such processing requires time, and conditions may change while operators process the samples. Processing time further delays changes to vessel operating conditions; this can result in suboptimal quality and/or capacity.

Delays in receiving information on operating parameters, especially residual alkali concentration, from the wash zone can cause delays in adjusting flows, particularly of wash liquid and cooking liquor. It is important to have sufficient residual alkali in the liquid obtained via the wash extraction screen to provide the desired product quality. That is, the alkali is an active ingredient in the cooking liquor. If operators detect insufficient residual alkali in the liquid from the wash extraction screen, this can indicate that the digester did not sufficiently treat the lignocellulosic material to cause the lignin to be broken down. U.S. Pat. No. 4,933,292 discloses an electrochemical method for directly measuring an alkali concentration close to the wall of the digester.

It is also important not to have an abundance of residual alkali in the liquid from the wash extraction screen to prevent wasting of cooking chemicals. An abundance of residual alkali may cause continued treatment of the lignocellulosic material beyond the desired point of reactions. In addition, an abundance of residual alkali results in costly inefficient use of cooking chemicals.

WO 2016/112203 discloses a monitoring and control system for a pressurized vessel. Such a system has multiple sensors on the exterior wall surface of the pressurized vessel. Multiple sensors extend into the pressurized vessel at a height, wherein the multiple sensors measure chip level, liquor level, and temperature within the pressurized vessel. Multiple electrochemical sensors are arranged in rings around the exterior wall surface of the pressurized vessel at multiple elevations along the pressurized vessel height. This system has some problems. Adding additional openings to the pressurized vessel configured to receive a nozzle and sensor can create areas of structural weakness in the wall of the pressurized vessel. As the needed openings have different size and their different horizontal positions means different pressures, almost every opening has to be dimensioned differently by pressure vessel design standards. The increased number of external holes will increase the probability that hot caustic liquors and steam may leak from the pressurized vessel.

Patent application US20090188641 mentions that the chip level measuring sensor can be attached on a central pipe. U.S. Pat. No. 5,547,545 discloses that a temperature distribution measuring cable can be installed on a center pipe of a digester.

SUMMARY OF THE INVENTION

Most of the sensors installed to the outer wall of the digester vessel will be located at elevations, which are above the third of the height of the vessel. Installation and wiring the remarkable amount of sensors on the vessel means that the installing personnel are lifted to those elevations at the site where the sensors are installed. As the operational conditions may differ at different sectors close to the walls of the vessel at a certain elevation, only one sensor attached to the wall cannot adequately represent the conditions, which are present at that elevation. Thus, several sensors should be installed around the vessel at the desired elevations for getting at least a reliable average result about the measured operating conditions close to the wall of the vessel. The sensors will be under the insulation layer of the digester which means plenty of extra installation work and cost for arranging the insulated service openings for the number of sensors.

It has been recognized that a central pipe of the digester can be utilized in a new way and new methods for the measurements of these parameters. The use of the central pipe allows utilizing a new kind of measuring devices within the digester and the measurements represent conditions within the center area of the process, which can be different than within the outer areas within the vessel. Prior art solutions have suggested installing individual sensors on the central pipe. That means that there are cables and maybe their shielding tubes on the downflow of chips collecting build up of processed material on them. For example a thermal sensor with its cables installed on the central tube can collect such build up so much that the sensor will be affected to varying degrees by normally hotter temperature of fed liquid within the central pipe.

An object of the present invention is to provide a reliable installation arrangement for monitoring sensors for a continuous digester so that the number of holes through the digester wall are avoided or minimized. The invention also may enable arranging the installation of the monitoring sensors within clean factory environment thus avoiding slow, costly and potentially dangerous installations at high elevations around the digester at site environment. Another object is to obtain real-time data about the process conditions in the center area of the digester. Another object is to receive information on operating parameters like chip level, liquor level, temperature profile and residual alkali concentration. The residual alkali concentration is the amount of active alkali in black liquor, which alkali is not consumed during cooking. The process and measurements are also minimally affected by build up of processed material on the arrangement. Advantageous embodiments are defined in the dependent claims. Instead of the digester, the vessel can be any other treatment vessel, which has a similar central pipe arrangement.

The digester vessel for chemical pulp has on the top of the vessel a feed material inlet and the bottom of the vessel is a digested material outlet. A central pipe is mounted coaxially within the digester. According to the invention, at least one several meters long sensor channel for installation of sensors and/or for the cables of the sensors is arranged along the outer wall of the central pipe. The at least one sensor channel is connected to at least one cable conduit for leading the cables of the sensors to the sensor channel. The cable conduit is designed to connect exterior of the vessel to the at least one sensor channel.

Installing the sensors on the central pipe is not as straightforward a solution as installing them from outside of the digester vessel. The central tower is at a high operating temperature and thus all parts and cables of the installations have to sustain the conditions.

A faulty sensor or cable cannot be replaced easily without emptying the digester and entering a cleaned vessel. Access of personnel to the sensor at elevated position inside the vessel is labourious to arrange and occasions for any service of the sensors are very rare. A digester may operate continuously over a year. The components thus have to be highly durable. Any leak can spoil the operation and components of the whole installation. Arranging the cables and sensors to the numerous installing positions at various elevations at long distances from the exterior of the vessel has to be carefully designed, planned and organized. The installation is not only preferred but it also enabled to be taking place effectively at least partially at factory conditions. That is in practice not possible with the outside installations. Due to transporting limitations, plate parts of the vessel are always welded together at the site. The central pipe can be produced from much fewer pieces. Preferably the central part comprising the concentric tubes and sensor channels are welded together and only the lowermost and uppermost parts of the central pipe are welded together inside the digester vessel, if is not possible to mount them as a complete installation. Preferably at least the cables of the sensors are preinstalled in their channels within the central part of the central pipe. In that case, the preinstalled part should comprise the cable channel.

Preferably the sensor channel has an outer wall which is welded from both sides of the outer wall onto the central pipe. The sensor channel may also be a concentric pipe on the central pipe. Then the surface of the arrangement has a round outer wall without any discontinuities. Then also the space under the concentric outer wall should be longitudinally partitioned by partition walls to at least two sensor channels for achieving support by the central pipe. Preferably the sensor channel extends down to the vicinity of the end of the outermost tube of the central pipe. Then it can be used to measure process conditions over that level. The sensor channel can be extended to a lower level over the outlet of the outermost tube and possibly over the subsequent outlets of concentric tubes. Then the channel can continue as a detached closed channel or the sensor channel has to cross over any outlet and continue along the next outermost tube. Lower process stages can also be reached from another lower sensor channel along a lower outermost tube, which sensor channel is connected to another cable conduit for leading cables out of the vessel.

Preferably, a sensor channel is partitioned to subchannels. More preferably the subchannels are attached only to the outer wall of the sensor channel. Then the sensor channel arrangement can be welded as a complete arrangement onto the central pipe and the subchannels do not have direct thermal contact to the outermost concentric pipe.

Preferably the sensors are for measuring the main conditions which are temperature, chip level, liquid interface, liquid level and/or residual alkali concentration. To gain a full view of the process and full utilization of additional costs of the arrangement, preferably the arrangement comprises different sensors for all or at least two of said conditions. The channels for the sensors enclose and shield cables and connectors of the sensors.

Preferably the arrangement contains at least one subchannel, which is designed and/or has at least cables for only one type of sensors, preferably thermal sensors. Advantageously at least one of the sensor channels or subchannels is insulated against thermal conductivity from the concentric pipes of the central pipe. Advantageously the insulated sensor channel contains thermal sensors, which sensors do not extend out of the sensor channel to the interior of the digester. Any protruding elements will resist the downflow of treated material and collect build up on them.

Preferably the sensor channel or a subchannel is provided with an evacuation tube which leads to the bottom of the sensor channel. The tube can then be used to pump out leaked liquid if any sealing of sensor holders causes a leak within the arrangement. If a cable conduit for the cables or another conduit from the sensor channel arrangement to the exterior of the vessel is positioned at the bottom of the sensor channel, the leaked liquid will flow out by gravity without the evacuation tube. The conduit at the bottom can also support the central pipe so that it will not bend and will stay within the center of the digester.

Preferably the sensor channel is connected to a source of pressurized fluid. If the sensor channel is pressurized, leaking of process fluids to the sensor channel is reduced or avoided. Having a higher pressure inside the sensor channel than is present outside within the vessel, any leak will be from the sensor channel to the interior of the vessel. Any leak to the interior of the vessel should not cause relevant contamination or dilution of the process.

Advantageously at a same elevation exist at least two of a same type of sensors and/or same type of sensors exist at different elevations. Then more representative results can be obtained along the length of the sensor channel arrangement. An obviously faulty sensor can also be omitted from measurement results without compromising measurement coverage of that elevation if there is at least two of a same type of sensors.

Advantageously the cables of the sensors are of different length and they are bundled so that the cables extend only up to their installing positions. Preferably such a cable bundle has cables for only one type of sensors. The bundles may be preinstalled with the connectors of the sensors. The bundles of especially thermal sensors are preferably provided with the sensors. Preferably only one cable bundle is fed to one channel so that a prior bundle does not resist feeding the latter bundle. Another solution to the problem is that all of the cable bundles for a same channel are fed simultaneously to the channel.

Advantageously the cables are fed to the channels before the central pipe is mounted to the digester. More advantageously the sensors are connected to the cables and installed to their positions before the central pipe is mounted to the digester.

A measuring device for chip level and liquor level is preferably a guided wave radar (GWR). Temperature profile can be measured with series of temperature sensors or using a distributed sensing cable. The distributed sensing cable is preferably an optical fibre cable with lighting and sensing means for Raman-scattering measurements. The distributed sensing cable can be used for gaining temperature values from different positions along the cable. Residual alkali concentration are preferably measured by electrochemical sensors, which are placed at multiple heights along the sensor channel. The residual alkali measurements are preferably compared to measurements of discharged liquid for calibrating purposes, as changes of properties or faults of the central sensors may happen due to contamination or other reasons.

DETAILED DESCRIPTION OF THE INVENTION

WO2016112203 describes process conditions within a digester vessel and types of sensors, which can be used for monitoring the conditions. The disclosed arrangements measure the conditions within the outer area of the vessel well, but having the monitoring sensors inside the center area of the vessel is more beneficial as they represent better the general conditions. Representative measurements can be obtained by far fewer sensors from the center area. In most cases, only one sensor at one elevation is needed for the monitoring task of the condition. The installations like the WO2016112203 discloses can initially or later be arranged with the current invention for further and/or comparative information needs and also for backup replacement of faulty sensors, but preferably with a limited number of sensors.

Figure 1:
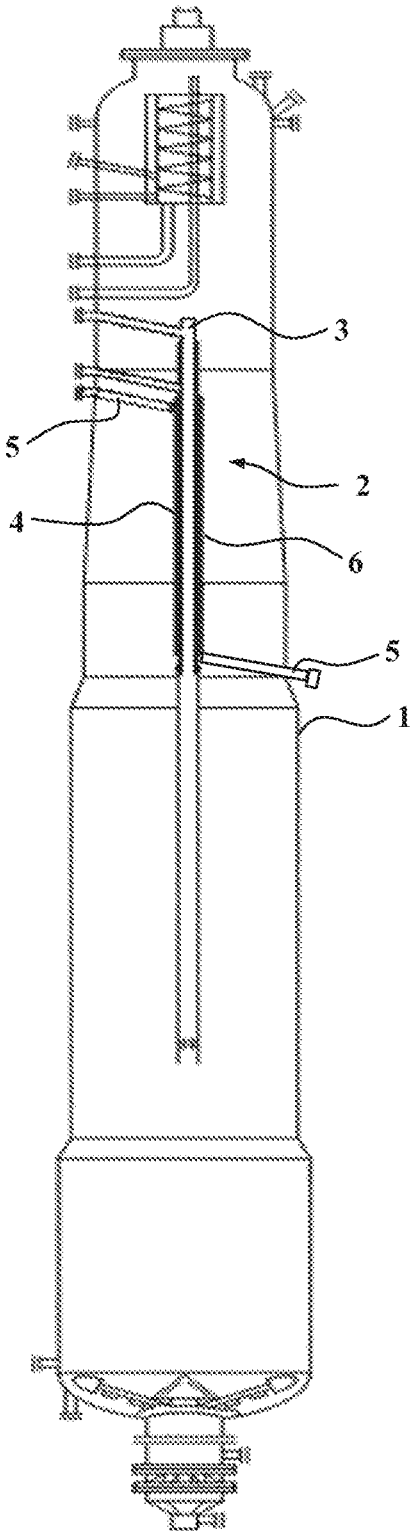
FIG. 1 shows a pressurized vessel with a central pipe arranged in the center area of the vessel and a sensor channel arranged on it.

FIG. 1 shows main parts of a digester for chemical treatment of lignocellulosic material. The central pipe 2 comprises concentric pipes 3. It is mounted coaxially within the digester vessel 1. It is used for adding liquor or other fluids to the center of the chip column inside the digester, in a specific elevation. Their discharge elevations are engineered according to the purpose of the fluid and the specific process zone.

The central pipe 2 may extend from the top part of the digester to the bottom part of it. Monitoring sensors 11 (FIG. 3) are placed at multiple points on an outer wall 6 of sensor channel 4 along the entire height of the central pipe 2. Thus they can obtain data about the process conditions at multiple elevations within the center part of the digester 1. Only the most active areas of the treating process may need to be monitored and the outer wall 6 of the sensor channel 4 thus may cover even less than half of the height of the central pipe 2. Typically the sensor channel 4 will still be at least 10 meters long. The more length and more sensors are installed the more economical the inventive solution economically is.

Four sensors or meters might be a minimum amount for meters and sensors for reaching enough benefits. At least one cable channel 5 is provided for leading cables 8 (FIG. 2) out from inside the sensor channel 4 out to the exterior of the digester. If the cable channel 5 is on top of the sensor channel 4, it is easier to feed and replace the cables 8. Another suitable or optional position for the cable channel 5 is at the bottom of the sensor channel 4 for leading leaked liquid out and for getting the operation period of the digester extended if the leak has a small enough volume. Flanged joint may exist between the sensor channel 4 and the cable channel 5 for easier installation and service, but for avoiding any leaks and extra flow resistance, it is not preferred.

The sensors 11 provide information for allowing monitoring of operating conditions and liquor composition, such as residual alkali, within the digester. With liquor composition information at various heights along the digester, a profile of the reaction characteristics within the digester can be developed. Once developed, the profile of the reaction characteristics can be used to adjust the concentration and rate of circulated or fresh liquid being added to digester between the various process zones, such as impregnation zone, cooking zone and washing zone, or even within a process zone thereby allowing for improved reaction characteristics within the digester.

Placing electrochemical residual alkali sensors 11 at multiple heights along the central pipe 2 allows operators to collect comprehensive, real-time data on the process occurring within the digester vessel 1. In addition to this data, residual alkali concentrations are preferably measured also by taking samples from the digester in a way known per se. The sensors 11 are desirably electrochemical sensors. Digitized measurement values from the electrochemical and other process monitoring sensors 11 are compared by control algorithms to desired parameters via an analyzer such as an "AIC" (analyzing indicating controller). The AIC may then send adjustment signals to various controllers to control the liquor flow rate, liquor strength, temperature and extraction and addition rates of various liquors to the pressurized vessel. The use of such electrochemical sensors 11 to gather the necessary process information allows for a short time between measurement and reaction to the measurements. The controlling tasks are preferably based on adaptive artificial intelligence and/or machine learning algorithms, which are also able to automatically react to faulted and/or contaminated sensors 11 and can adjust control parameters.

Figure 2:
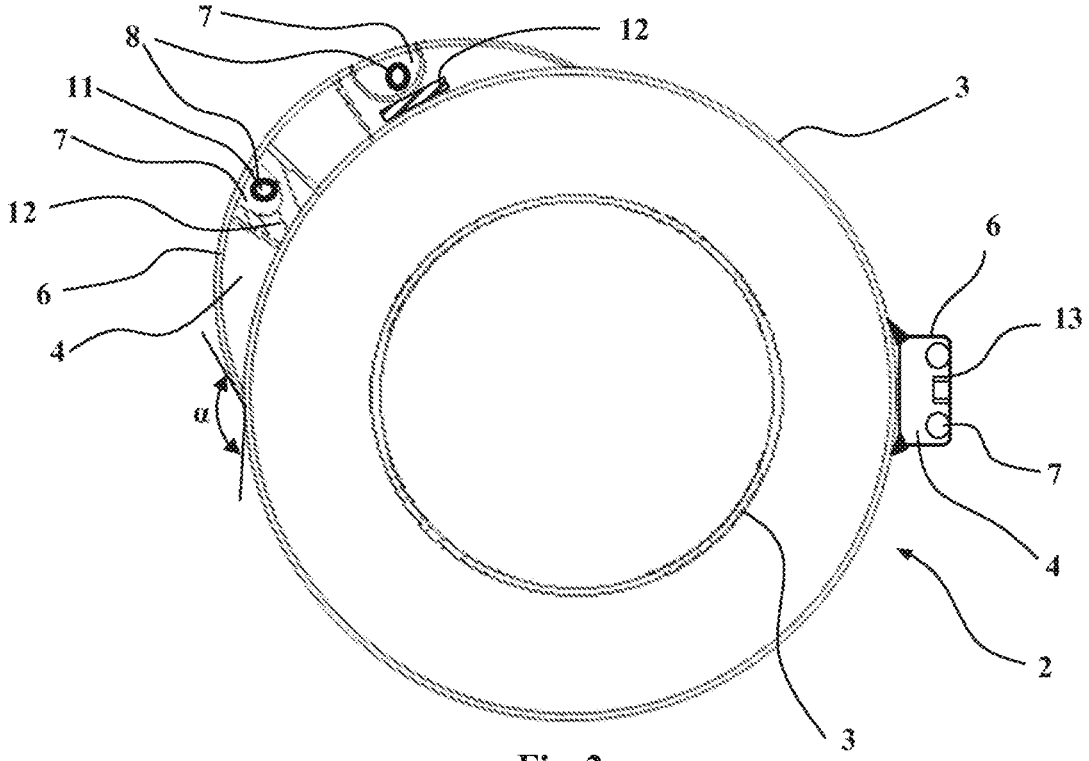
FIG. 2 shows a cut view of embodiments of the sensor channel arrangement.

FIG. 2 shows an outer wall 6 of a sensor channel 4 welded from both sides to the outermost concentric pipe 3 of the central pipe 2. The interior of the wall 6 may be divided by partition walls, tubes and/or gutters to subchannels 7. The tubes and gutters should only be joined to the outer wall 6 of a sensor channel 4. More than one such outer wall 6 of the sensor channel 4 with optional sets of subchannels 7 may be arranged aside the central pipe 2. The width of subchannels 7 or the wall 6 of the sensor channel 4 should be limited to be below 250 mm so that cables and connectors of the sensors 11 can easily be reached through the opening of sensor holders 13. Still the wall 6 of the sensor channel 4 should be smoothly joined to the central pipe 2 for not hindering the flow of treated material around the central pipe 2. Thus the outer wall 6 is preferably always divided by partition walls to a narrower subchannels 7 to accomplish a narrow enough channeling. An example, which uses a profiled tube a sensor channel 4 is illustrated at right side of the central tube 2. Temperature profile can be measured with several temperature sensors 11 installed along the central pipe 2. The cables 8 of the sensors 11 are preferably bundled to cable bundles. A sensor channel 4 may be insulated against thermal conductivity from the coaxial liquid pipes 3. As the temperatures within coaxial pipes 3 are at quite the same level, the insulation should be sufficient even without additional insulating material 12 when an insulated subchannel 7 is only joined to the outer wall 6 and it is not connected to the outermost coaxial channel 3. Then the temperature of the outer wall 6 is conducted also to the gutter or tube of the subchannel 7, which enables fulfilling the thermal measuring purpose. Vertical temperature profile can be measured by thermal sensors 11, which are positioned at different elevations inside the insulated subchannel 7. The temperature outside of the outer wall 6 should then be the same as or highly relative to the temperature of the thermal sensors inside the subchannel 7. The bundle of cables 8 for thermal sensors 11 may also be provided with preferably profiled insulating material 12, which suit to the subchannel 7 and restrict horizontal and/or vertical movement of air and heat within the subchannel 7. The bundle of thermal sensors 11 or a distributed sensing cable preferably is installed to an as narrow as possible subchannel 7 joined only to the outer wall 6.

The sensor channel 4 may also be formed from a suitably profiled tube attached on the coaxial pipe 3. Preferably is attached by continuous welds along the coaxial pipe 3, as the sensor channel 4 must not be able to separate from the central pipe during operation of the digester. A round tube is not a preferred profile as there should not be any sharp corners nor space or discontinuities between the outer wall of the sensor channel and the coaxial pipe 3. Otherwise treated material may build up around the central pipe 2 and the sensor channel 4. More preferably the corner a should be more than 120 degrees.

Figure 3:
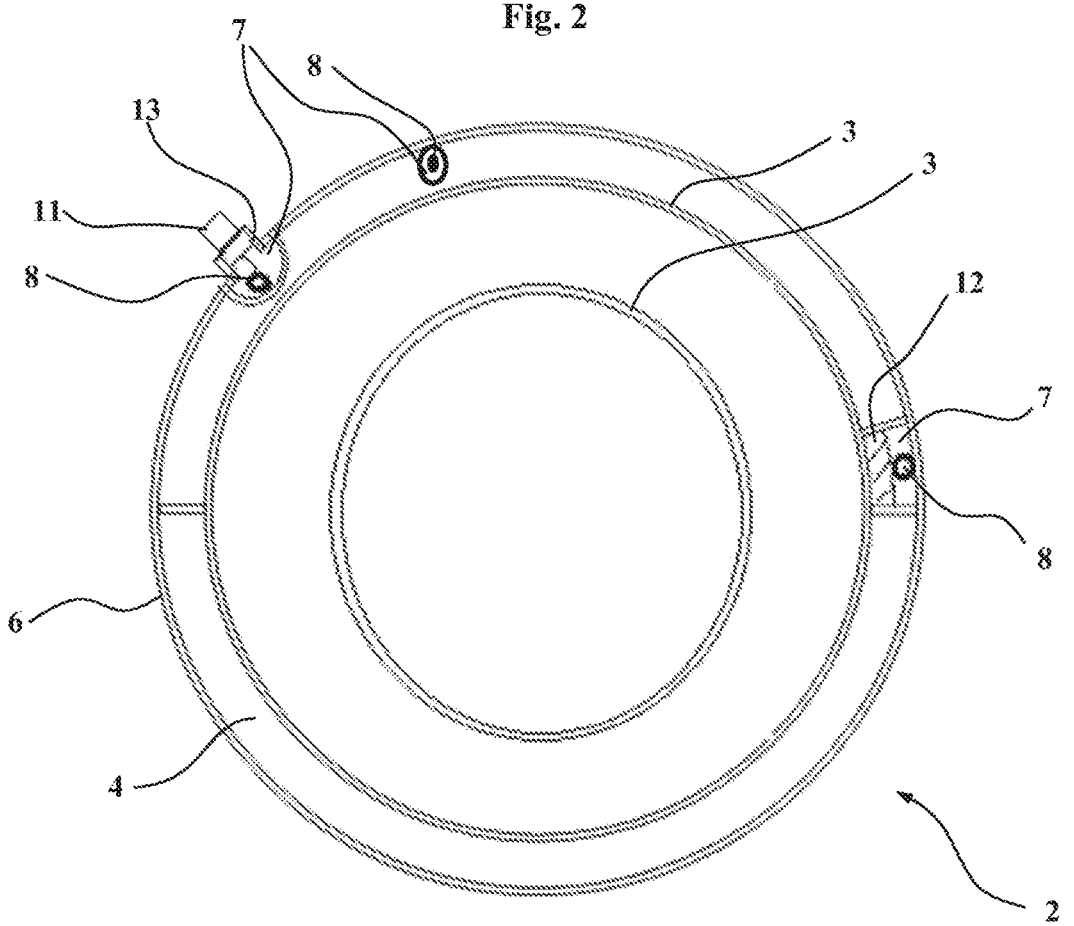
FIG. 3 shows a cut view of an embodiment of the sensor channel arrangement.

FIG. 3 shows a cut view of another embodiment of the sensor channel 4 arrangement. Detailed embodiments of arrangements presented in connection with FIG. 2 can be used similarly with arrangements of FIG. 3 and vice versa except the design of the outer wall 6. The outer wall 6 of the sensor channel 4 is now coaxial with the central pipe 2. The structure is stiffer than the arrangement of FIG. 2 and symmetric, which is beneficial in keeping the central pipe coaxially centered within the digester vessel 1. The interior of the outer wall 6 should be spaced apart from the coaxial pipe 3 by at least two partition walls, which will form at least two sensor channels 4.

Sensors 11 may be installed within a holder 13. The holder 13 is mounted on the outer wall 6 of the sensor channel 4 and it is configured to hold the sensor 11. Cables 8 of the sensors 11 are preferably bundled together and led via the sensor channel 4 to the top part and out through a lead-through flange from the vessel 1 of the digester. An electronic unit, which digitizes and/or transmits the measurement data from cables 8 to a process controller 16 (FIG. 4), is preferably located outside the digester.

Figure 4:
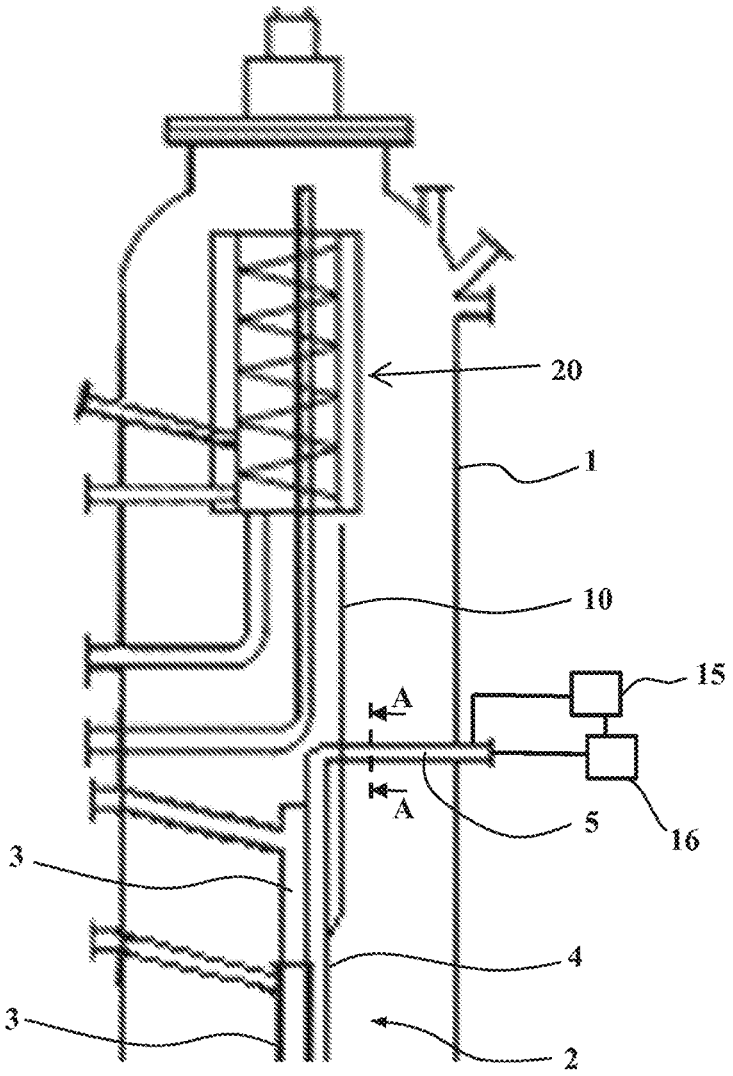
FIG. 4 shows an embodiment of top part of the sensor channel arrangement on the central pipe.

FIG. 4 shows an embodiment of a cable conduit 5 arrangement on top of the sensor channel 4. A sensor channel 4 extends to a cable channel 5 higher than the coaxial pipes 3 in this embodiment. This is best achieved by the embodiment of FIG. 2, as it is costly to extend a coaxial outer wall 6 of the sensor channel 4 over the inlet tubes of coaxial pipes 3. Similarly, the arrangement of FIG. 2 can be extended below the central pipe 2 where the wall thickness of the digester 1 vessel will be much thicker and pressure higher than in the upper part and making openings is thus more critical and should be avoided. By the extensions, the sensors 11, which need to be installed to the digester at those higher and lower elevations can be installed on the sensor channel 4. Preferably every sensor channel 4 and their subchannels 7 are connected to the same cable conduit 5. Otherwise the cable conduits 5 hinder and divert downflow of the treated material, which may cause uneven treatment results. From the sensor channels cables 8 are connected to a process controller 16 maybe via electronic subcontrollers. Preferably, the cable conduit 5 is opposite to inlets of coaxial pipes 3 for balancing the downflow. The upper ends of the cable conduit 5 and central pipe 2 may be below a top separator 20 in the vessel 1.

The installation of sensors 11 on the sensor channel 4 allows utilizing new kind of measuring devices within the digester. One such measuring device is a guided wave radar (GWR) for measuring and controlling liquor level and/or chip level within the top part of the digester. A GWR transmitter and receiver unit sends electromagnetic pulses toward a measured level and use the reflected signal to calculate the level in the tank. With GWR, the measured signal pulse travels along the waveguide 10 of the GWR. When the pulse hits the liquid, an indicative proportion of the energy is reflected back up to the transmitter and receiver unit, which then calculates the levels of the materials from the time difference between the pulse sent and the pulse reflected.

GWR technology has the ability to measure any interface level. Because a proportion of the emitted pulse will continue along the waveguide 10, the liquid interface can be detected. The GWR has the ability to detect the top liquid level of the media as well as any "interface level" or level of the media that is below the liquid level, which contains a different property than the top liquid level being measured. Thus it is possible to measure a chip level if it is lower than the liquor level, or vice versa.

The waveguide 10 can be made of a stiff metallic rod, flexible wire or a coaxial construction. The transmitter, to which the sensor is connected, can be located outside the digester. The GWR's waveguide can be installed easily through a relatively small lead-trough mounted on the outer wall 6 of the sensor channel 4 and so be led to the central interior of the digester, where the waveguide 10 is attached on the wall 6 of the sensor channel 4 or on the central pipe 2.

If the sensor channel 4 is closed i.e. also the connectors and/or leadthroughs of the cables 8 are leakproof. Then the sensor channel 4 can be pressurized by a source 15 of pressurized fluid connected to the sensor channel 4, preferably via cable channel 5. The sensor channel 4 is preferably pressurized by a gas and more preferably by an inert gas like nitrogen. The pressure is preferably up to 1 bar higher that pressure outside the sensor channel 4 at any elevation, where holders 11 for the sensors 11 exist. A suitable liquid like clean water may also be used as a pressurizing fluid, if all wirings, sensors 11 and connectors are leakproof. If a leak occurs, it can be detected by a pressure drop and/or by a need to fill up the pressurizing fluid from the source 15 of pressurized fluid to the sensor channel 4. If a pressurized sensor channel 4 or subchannel 7 is separated from other sensor channels 4, the leaking channel can be identified. Sensors, valves and/or pumps of the source 15 of pressurized fluid are preferably connected to the process controller 16 or another controller for controlling the pressure within the sensor channel 4. The process controller 16 may be configured for determination and/or indication of any leaks a leak out of the sensor channel 4 and/or the subchannel 7 and/or the cable conduit 5.

In certain embodiments, the GWR or other sensors 11 may provide information regarding the density of the column of chips. The information relating to the density of the column of chips can be monitored to develop a profile along the height of the digester. Inconsistencies, variations or fluctuations in the profile of the density of the column of chips may indicate channeling (i.e. areas within the column of chips with varying densities where streams of liquor may form and result in inconsistent reaction characteristics or other process upset condition within the column of chips). By monitoring the density of the column of chips directly and in real-time, undesirable operations of the digester are quickly recognized and addressed to minimize or eliminate unfavorable operating conditions.

Figure 5:
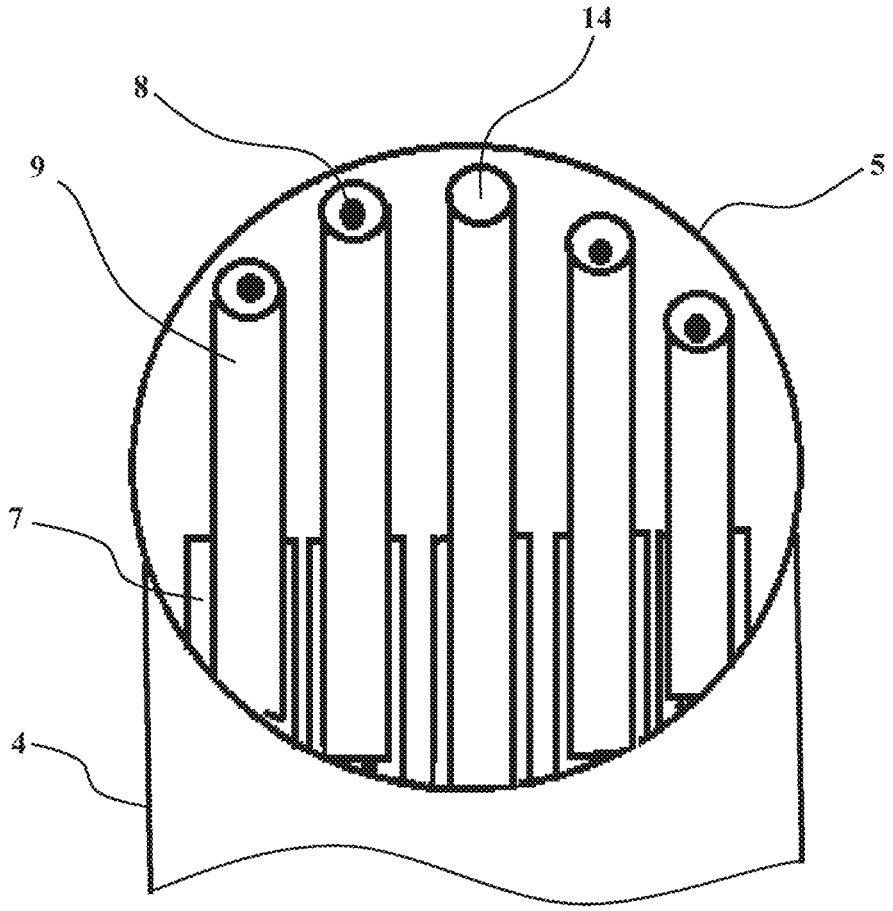
FIG. 5 shows a preferred cable conduit arrangement at the top of the sensor channel.

FIG. 5 shows a cut view A-A of a preferred cable conduit 5 arrangement at the end of the cable channel 4. Subchannels 7 preferably extend over the bottom level of the cable conduit 5. Then it is easy to install cable tubes 9, which will lead the cables 8 to the subchannels 7 through the cable channel 5 when cables are installed. Preferably an evacuation tube 14 leads to the bottom of the cable channel 4 for discharging leaked liquids from the bottom of the cable channel 4. A level switch and preferably a pump should be mounted on the bottom end of the tube 14. If the cable channel 5 or another channel is mounted on the bottom of the sensor channel 4, the tube 14 and the pump can be omitted.

Pressurizing the sensor channel 4 can also be used for exhausting leaked liquid.

The invention claimed is:

1. An arrangement for installations of monitoring sensors of a vessel configured to treat lignocellulosic material, wherein the vessel includes a central pipe extending generally vertically through a center of the vessel and comprising at least one concentric pipe mounted coaxially within the vessel, wherein the central pipe extends downward into a lower half of the vessel, the arrangement comprising:

at least one sensor channel arranged along an outermost wall of the at least one concentric pipe of the central pipe, and a cable conduit connected to the at least one sensor channel and connected to an exterior of the vessel, wherein the at least one sensor channel is at least one meter long and includes at least one of:

a plurality of sensor holders mounted to the sensor channel and configured to hold sensors, or a plurality of thermal sensors and cables for the thermal sensors within the at least one sensor channel.

2. The arrangement of claim 1, wherein an interior of the at least one sensor channel is longitudinally divided into at least two sensor channels.

3. The arrangement of claim 1, wherein an outer wall of the at least one sensor channel is welded along opposite longitudinal sides of the outermost wall of the at least one concentric pipe of to-the central pipe.

4. The arrangement of claim 1, wherein the at least one sensor channel includes a plurality of subchannels.

5. The arrangement of claim 4, wherein the at least one of the subchannels is entirely supported by an outer wall of the at least one sensor channel.

6. The arrangement of claim 1, wherein the at least one sensor channel includes a sealed channel connected to a source of pressurized fluid.

7. The arrangement of claim 6, wherein the source of the pressurized fluid is connected to a controller configured to determine a leak in the sealed channel.

8. The arrangement of claim 1, wherein the at least one sensor channel:

extends vertically beyond at least one of the at least one concentric pipe of the central pipe, or has an end proximate an outlet of the outermost wall of the at least one concentric pipe.

9. The arrangement of claim 1, wherein the cable conduit connects to at least one of a top end or a lower end of the at least one sensor channel.

10. The arrangement of claim 1, wherein the cable conduit includes at least one of:

a cable tube extending through the cable conduit and into the at least one sensor channel, or an evacuation tube extending through the cable conduit and to a bottom of the at least one sensor channel.

11. The arrangement of claim 1, wherein the plurality of sensors include at least one of a temperature sensor, a chip level sensor, a liquid interface sensor, a liquid level sensor, or a residual alkali concentration sensor.

12. The arrangement of claim 1, wherein the at least one sensor channel is insulated against thermal conductivity from an outermost wall of the at least one concentric pipe of the central pipe.

13. The arrangement of claim 11, wherein the at least one sensor channel is insulated against thermal conductivity from an outermost concentric pipe of the at least one concentric pipe, and the at least one sensor channel includes the thermal sensors which do not extend out of the at least one sensor channel into an interior of the vessel.

14. The arrangement of claim 1, further comprising at least one of:

a plurality of sensors of the same type at a same elevation level in the at least one sensor channel, or at least two sensors of the same type arranged at different elevations in the at least one sensor channel.

15. The arrangement of claim 1, wherein the at least one central pipe includes a plurality of pipes.

16. The arrangement of claim 1, wherein the cable conduit is connected to a lowermost portion of the at least one sensor channel and extends radially to and through an outer wall of the vessel.

17. The arrangement of claim 16, wherein the cable conduit is downwardly slanted from the at least one sensor channel to the outer wall of the vessel.

18. The arrangement of claim 16, wherein the cable conduit extends through the outer wall at an elevation of the vessel immediately above an expansion section of the vessel where a cross-sectional area of the vessel expands in a downward direction.

* * * * *